US006893228B2

(12) United States Patent
Nelson

(10) Patent No.: US 6,893,228 B2
(45) Date of Patent: May 17, 2005

(54) AXIAL PISTON PUMP WITH FLUID BEARING ARRANGEMENT

(75) Inventor: Bryan E. Nelson, Lacon, IL (US)

(73) Assignee: Caterpillar Inc, Peoria, IL (US)

( * ) Notice: Subject to any disclaimer, the term of this patent is extended or adjusted under 35 U.S.C. 154(b) by 100 days.

(21) Appl. No.: 10/301,679

(22) Filed: Nov. 22, 2002

(65) Prior Publication Data

US 2004/0101419 A1 May 27, 2004

(51) Int. Cl.[7] ..... F04B 27/08

(52) U.S. Cl. ..... 417/270; 417/270; 91/499; 91/504; 91/506; 92/12.2

(58) Field of Search ..... 417/270; 91/499, 91/504, 506; 92/12.2

(56) References Cited

U.S. PATENT DOCUMENTS

| | | | | | |
|---|---|---|---|---|---|
| 2,517,008 | A | | 8/1950 | Marshall et al. | |
| 2,588,481 | A | | 3/1952 | Chandler | |
| 2,806,430 | A | | 9/1957 | Osborne | |
| 3,020,847 | A | | 2/1962 | Rohrberg | |
| 3,657,970 | A | | 4/1972 | Kobayashi et al. | |
| 3,726,609 | A | | 4/1973 | Cattanach | |
| 3,810,715 | A | * | 5/1974 | Week et al. | 417/213 |
| 3,847,057 | A | * | 11/1974 | Ital et al. | 91/6.5 |
| 3,908,519 | A | * | 9/1975 | Born et al. | 92/12.2 |
| 4,850,812 | A | | 7/1989 | Voight | |
| 5,515,829 | A | * | 5/1996 | Wear et al. | 417/222.1 |
| 5,603,609 | A | * | 2/1997 | Kadlicko | 417/270 |
| 5,971,717 | A | | 10/1999 | Berthold | |
| 6,035,828 | A | | 3/2000 | Anderson et al. | 417/269 |
| 6,113,359 | A | | 9/2000 | Watts et al. | |
| 6,244,160 | B1 | | 6/2001 | Kunze | |
| 6,510,779 | B2 | * | 1/2003 | Greene et al. | 91/504 |

* cited by examiner

*Primary Examiner*—Cheryl J. Tyler
*Assistant Examiner*—Emmanuel Sayoc
(74) *Attorney, Agent, or Firm*—Finnegan, Henderson, Farabow, Garrett & Dunner

(57) ABSTRACT

A pump includes a stationary pump housing having a central longitudinal axis and a housing chamber, a rotating pump shaft extending through the pump housing and into the housing chamber, a rotating barrel fixed to the pump shaft and including a plurality of pump chambers, and a plurality of rotating and reciprocating pump pistons. Each pump piston is at least partially contained within a respective pump chamber. A fluid delivery control assembly is provided to selectively vary the amount of fluid delivered by the pump. At least one pressurized fluid pool is located between a portion of the rotating barrel and a portion of the pump housing. The pressurized fluid pool may be located along an end surface of the rotating barrel and/or along a side of the rotating barrel.

35 Claims, 4 Drawing Sheets

AXIAL PISTON PUMP WITH FLUID BEARING ARRANGEMENT

TECHNICAL FIELD

This invention relates generally to hydraulically-actuated systems used with internal combustion engines, and more particularly to an axial piston pump of a high pressure hydraulically-actuated system.

BACKGROUND

Axial piston pumps are known to be used in hydraulically-actuated fuel injection systems. The efficient operation of such pumps is significant to the overall operation of the engine. Moreover, the ability of such pumps to operate free of maintenance is important to reduce downtime of the system. While efficient operation is an important design criteria, issues such as weight, size, cost, and ease of assembly influence the overall design of such pumps.

U.S. Pat. No. 6,035,828 to Anderson et al. describes a fixed displacement, variable delivery axial piston pump for a hydraulically-actuated fuel injection system. In the system, a high pressure common rail supplies hydraulic fluid to a plurality of hydraulically-actuated fuel injectors mounted in a diesel engine. The hydraulic fluid received in the common rail is pressurized by the fixed displacement axial piston pump that is driven directly by the engine. The pump includes a plurality pistons disposed in parallel about the central longitudinal axis of the pump, and reciprocation of the pistons is achieved by the rotation of an angled camming surface or swash plate that is biased against a proximal end of the pistons. Displacement of the pump is varied by a control valve that selectively varies the amount of pressurized fluid supplied to the pump outlet during the discharge stroke of each piston.

While the Anderson et al. pump performs well in operation, the axial forces created during a piston's discharge stroke act against the swash plate and the pump shaft connected to the pump shaft so as to require the use of axial bearings on the pump shaft. FIG. 2 of Anderson et al. illustrates two opposed tapered roller bearing arrangements for receiving axial forces created during pump operation. Such mechanical bearings have a limited life. Accordingly, the bearings or the entire pump need to be replaced each time the bearings fail. Further, the space, weight, cost and assembly aspects of the pump are adversely affected by the need to include such mechanical bearings.

The present invention provides an axial piston pump that avoids some or all of the aforesaid shortcomings in the prior art.

SUMMARY OF THE INVENTION

In accordance with one aspect of the invention, a pump includes a stationary pump housing having a central longitudinal axis and a housing chamber, a rotating pump shaft extending through the pump housing and into the housing chamber, a rotating barrel fixed to the pump shaft and including a plurality of pump chambers, and a plurality of rotating and reciprocating pump pistons. Each pump piston is at least partially contained within a respective pump chamber. A fluid delivery control assembly is provided to selectively vary the amount of fluid delivered by the pump. At least one pressurized fluid pool is located between a portion of the rotating barrel and a portion of the pump housing.

According to another aspect of the present invention, a method of reducing wear in a pump includes pressurizing fluid during a discharge stroke of at least one piston of the pump, and forming a contained pool of a portion of the pressurized fluid between portions of opposed surfaces of a rotating barrel and a housing of the pump. The rotating barrel includes at least one pump chamber housing at least a portion of the at least one piston.

According to yet another aspect of the present invention, a hydraulically actuated system includes a pump having a central longitudinal axis, a rotating pump shaft, a rotating barrel fixed to the pump shaft, a plurality of rotating and reciprocating pump pistons at least partially located in pump chambers of the rotating barrel, a fluid delivery control assembly and at least one pressurized fluid pool located between a portion of the rotating barrel and a portion of the pump housing. A high pressure rail is connected to the pump. At least one hydraulically actuated fuel injector is connected to the high pressure rail. An electronic control module is provided that is in communication with and capable of controlling the fluid delivery control assembly.

According to still another aspect of the present invention, a pump includes a stationary pump housing having a central longitudinal axis and a housing chamber, a rotating pump shaft extending through the pump housing and into the housing chamber, a rotating barrel fixed to the pump shaft and including a plurality of pump chambers, and a plurality of rotating and reciprocating pump pistons disposed in parallel about the central longitudinal axis of the pump housing. Each pump piston is at least partially contained within a respective pump chamber. A fluid delivery control assembly configured to selectively vary the amount of fluid delivered by the pump, the assembly having a plurality of slidable sleeves. Each slidable sleeve is located on a respective piston and is controllably positionable to uncover a port in the pump piston that is fluidly connected to the pump chamber. A plurality of pressurized fluid pools are located within a hollow portion of a protrusion located on one of the rotating barrel and pump housing and between a portion of an end surface of the rotating barrel and a portion of the pump housing.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several exemplary embodiments of the invention and together with the description, serve to explain the principles of the invention.

DETAILED DESCRIPTION

Reference will now be made in detail to the exemplary embodiments of the invention, examples of which are illustrated in the accompanying drawings. Wherever possible, the same reference numbers will be used throughout the drawings to refer to the same or like parts.

Figure 1:
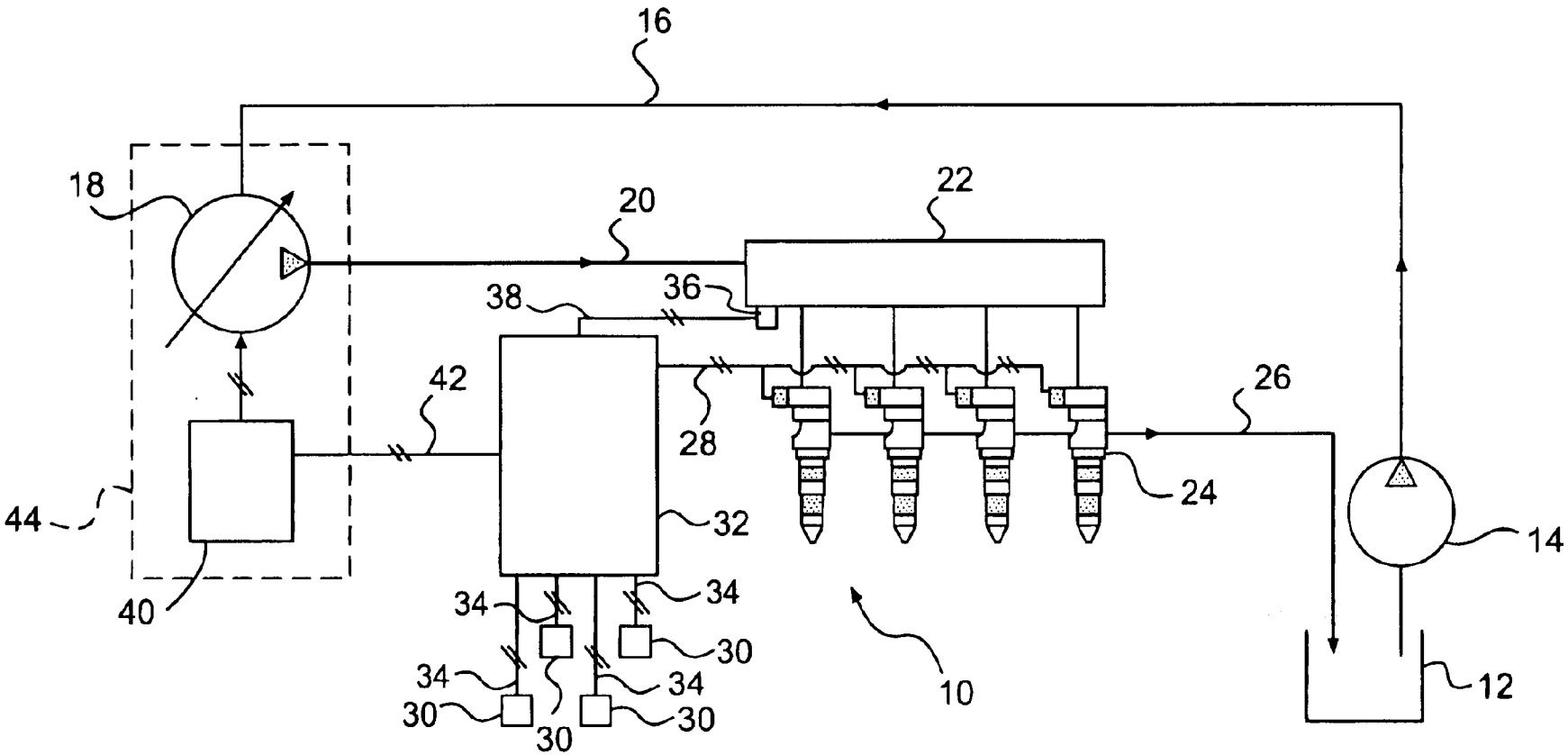
FIG. 1 is a schematic illustration of a hydraulically-actuated fuel injection system according to an exemplary embodiment of the present invention.

Referring now to FIG. 1, a working fluid circuit 10 for a hydraulically-actuated fuel injection system may make up a component of an internal combustion engine. Working fluid circuit 10 may include a source of low pressure working fluid 12, which may be, for example, the engine's lubricating oil sump. A supply pump 14 may supply working fluid through a low pressure supply line 16 to a high pressure axial piston pump 18. Axial piston pump 18 may then supply high pressure working fluid along high pressure supply line 20 to a high pressure common fluid rail 22. High pressure fluid rail 22 is fluidly connected to each of the fuel injectors 24 and selectively supplies high pressure working fluid to drive fuel injectors 24. After the high pressure working fluid is utilized by the individual fuel injectors 24, the working fluid may be returned to sump 12 via a drain passage 26.

As is well known in the art, the desired pressure in high pressure rail 22 is generally a function of the engine's operating condition. For instance, at high speeds and loads the rail pressure is generally desired to be significantly higher than the desired rail pressure when the engine is operating at an idle condition. A series of engine operating condition sensors 30 may be coupled to the engine at various locations to provide an electronic control module 32 with data through communication lines 34. Sensors 30 may detect engine parameters including, for example, engine speed, engine crankshaft position, engine coolant temperature, engine exhaust back pressure, air intake manifold pressure or throttle position. In addition, a pressure sensor 36 may provide electronic control module 32 with a measure of the fluid pressure in high pressure rail 22 via a communication line 38. The electronic control module 32 may be designed to compare a desired rail pressure, which is a function of the engine operating condition, with the actual rail pressure as measured by pressure sensor 36.

If the desired and measured rail pressures are different, the electronic control module 32 may command movement of a fluid delivery control assembly 40 via a communication line 42. The position of control assembly 40 determines the amount of working fluid that leaves pump 18 via high pressure supply line 20 and goes to high pressure rail 22. Both control assembly 40 and pump 18 may be contained in a single stationary pump housing 44. Further, electronic control module 32 may be coupled to each fuel injector 24 via communication line 28 to provide control signals to the working fluid valves of each fuel injector 24 to control the timing and duration of each fuel injection.

Figure 2:
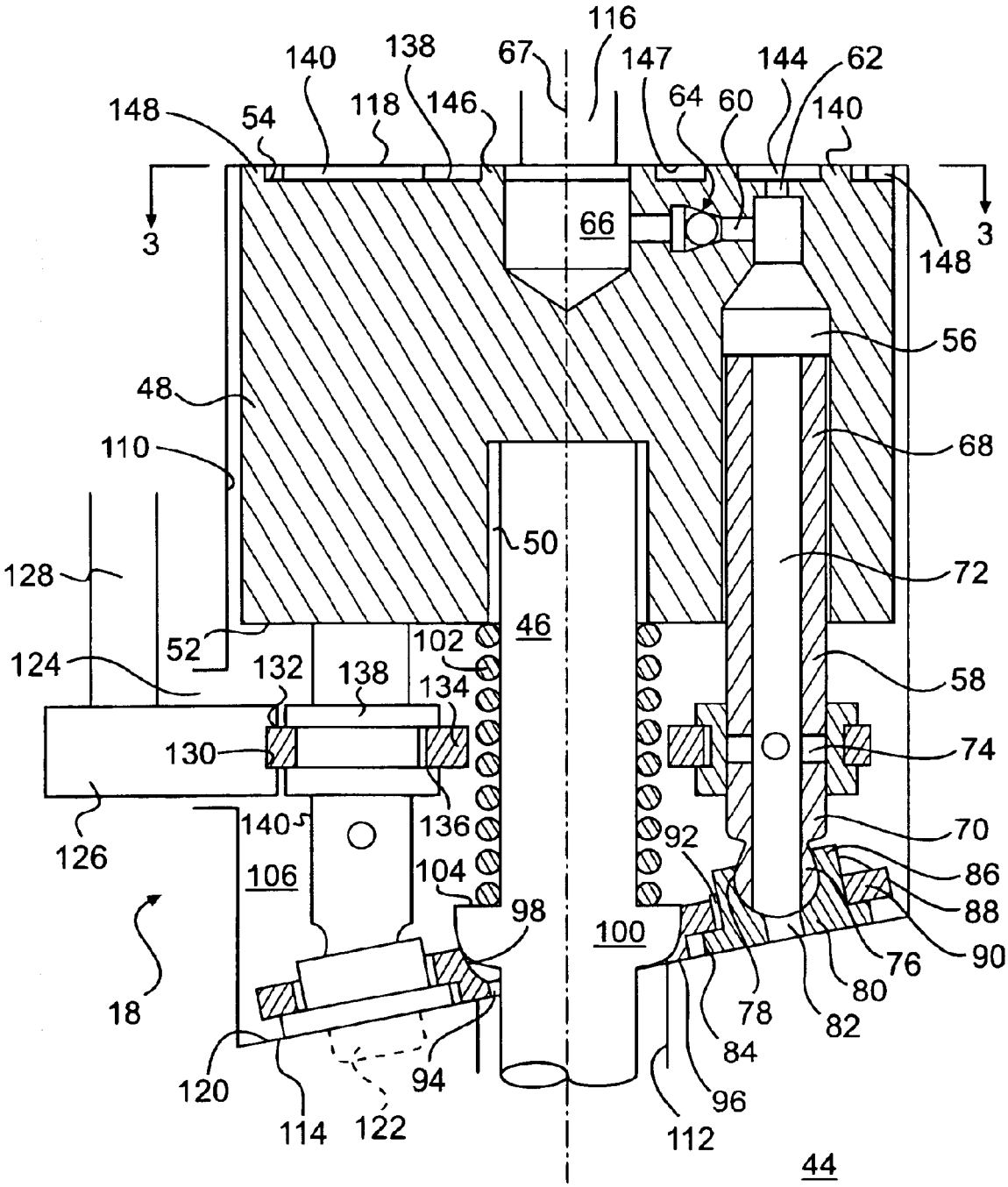
FIG. 2 is a cross-section diagrammatic view of an axial piston pump according to an exemplary embodiment of the present invention.

Referring now to FIG. 2, pump 18 may include a rotating shaft 46 that is coupled directly to the output of the engine, such that the rotation rate of shaft 46 is directly proportional to the rotation rate of the drive shaft (not shown) of the engine. A rotating pump barrel 48 may be fixedly attached to shaft 46 via a spline engagement 50 so that shaft 46 and pump barrel 48 rotate together. Any other suitable arrangement may be used to fixedly secure pump barrel 48 to shaft 46.

Pump barrel 48 may include a proximal end 52 and a distal end 54, and may be formed in a generally cylindrical shape. Proximal end 52 of pump barrel 48 may include a plurality of pump chambers or openings 56 for receiving a plurality of pump pistons 58. For example, pump barrel 48 may include five pump chambers 56 for receiving five pump pistons 58. Pump barrel 48 may also include a plurality of additional chambers or passages associated with each pump piston 58. These additional passages may include, for example, a high pressure outlet passage 60 fluidly connected to pump chamber 56 and a fluid pool passage 62 also fluidly connected to pump chamber 56. High pressure outlet passage 60 for each pump piston 58 may include a check valve 64, or other suitable mechanism, to provide one-way fluid flow from pump chamber 56 through outlet passage 60. The outlet passage 60 for each pump chamber 56 may converge into a central outlet 66 centered about a common central longitudinal axis 67 of the pump barrel 48, pump housing 44, shaft 46 and pump 18. Central outlet 66 may communicate with high pressure supply line 20 (FIG. 1). Central outlet 66 may be formed in any other suitable manner so as to provide for eventual connection with high pressure supply line 20.

Each pump piston 58 may be formed in a cylindrical shape having a distal portion 68, proximal portion 70 and an axial bore 72 extending completely through the pump piston 58 in a direction parallel to the central longitudinal axis 67 of pump 18. As will be described in more detail below, a plurality of radial ports 74 may extend from axial bore 72 radially though respective wall portions of pump piston 58.

Pump piston 58 may be formed with a spherically-shaped proximal end 76 so as to mate with a partially spherically-shaped recess 78 of a piston shoe 80. The mating of pump piston proximal end 76 with recess 78 of piston shoe 80 forms a ball-and-socket type coupling allowing for relative angular movement between pump piston 58 and piston shoe 80, but does not allow relative axial movement between the elements. Any other suitable coupling may be used to connect pump piston 58 and piston shoe 80, so long as the coupling allows for angular relative movement and limited axial relative movement. Piston shoe 80 may also include a bore 82 extending from its proximal end 84 into recess 78 and aligned to communicate with axial bore 72 of pump piston 58. Proximal end 84 of piston shoe may form a bearing surface against pump housing 44. A distal end 86 of piston shoe 80 may include a recess or groove 88 thereon to receive a biasing plate 90.

Biasing plate 90 may include a plurality of shoe holes 92 equally spaced about a center hole 94 and a proximal bearing surface 96 located adjacent center hole 94 for contacting pump housing 44. Shoe holes 92 may allow piston shoe 80 to extend therethrough for the length of recess or groove 88, and center hole 94 may include a rounded portion 98 for receiving a similarly shaped rounded protrusion 100 of shaft 46. Rounded shaft protrusion 100 may be located on a distal side of biasing plate 90. A compression spring 102 may extend between pump barrel 48 and a planar portion 104 of protrusion 100 to bias protrusion 100 into rounded portion 98 and against biasing plate 90. This, in turn, urges biasing plate 90 and piston shoes 80 against pump housing 44. Any other suitable arrangement of elements may be used to bias pump pistons 58 and piston shoes 80 against pump housing 44.

Pump housing 44 may include a housing chamber 106 for receiving pump barrel 48, pump pistons 58, piston shoes 80, biasing plate 90 and a portion of shaft 46. A side 110 of housing chamber 106 may form a circular cross-section of a dimension slightly larger than a diameter of pump barrel 48 to allow rotation of pump barrel 48 in housing chamber 106.

Pump housing 44 may also include a shaft opening 112 at its proximal end 114 and an outlet passage 116 at its distal end 118. Shaft opening 112 may communicate with housing chamber 106 and receive a portion of shaft 46 therethrough. Outlet passage 116 may communicate with high pressure supply line 20 (FIG. 1) and with housing chamber 106, and may be aligned with central outlet 66. Proximal end 114 of pump housing 44 may include an angled bearing surface 120 for bearing against proximal end 84 of piston shoes 80 and bearing surface 96 of biasing plate 90. Pump housing 44 may also include an inlet passage 122 (shown in dashed lines) extending from a supply fluid source, such as housing chamber 106, to a portion of angled bearing surface 120. Inlet passage 122 may form a kidney-shaped opening (not shown) in angled bearing surface 120 aligned to provide fluid communication with axial bore 72 of pump piston 58 through bore 82 of piston shoe 80 at a range of angular positions of shaft 46 corresponding to the suction strokes of each pump piston 58. The inlet passage 122 and outlet passages 60 may be formed in any other suitable manner allowing for the flow of fluid into and out of axial bore 72 during a pumping stroke.

Pump housing 44 may also include a passage 124 to housing chamber 106 for receiving a control lever 126 connected to a piston actuator 128. Control lever 126 may include a bearing groove 130 for receiving an outer radial surface 132 of a rotating idler ring 134. Idler ring 134 may be formed with a plurality of holes 136, each hole corresponding to the location of a pump piston 58. Holes 136 may include a control sleeve 138 fixedly coupled therein. Control sleeves 138 are configured to slide axially along a portion of an outer surface 108 of pump piston 58 in the vicinity of radial ports 74. As will be described in more detail below, the aforesaid connection of elements provides for movement of control sleeves 138 to cover or uncover radial ports 74 in pump piston 58 based on movement of piston actuator 128 in a proximal or distal direction.

Figure 3:
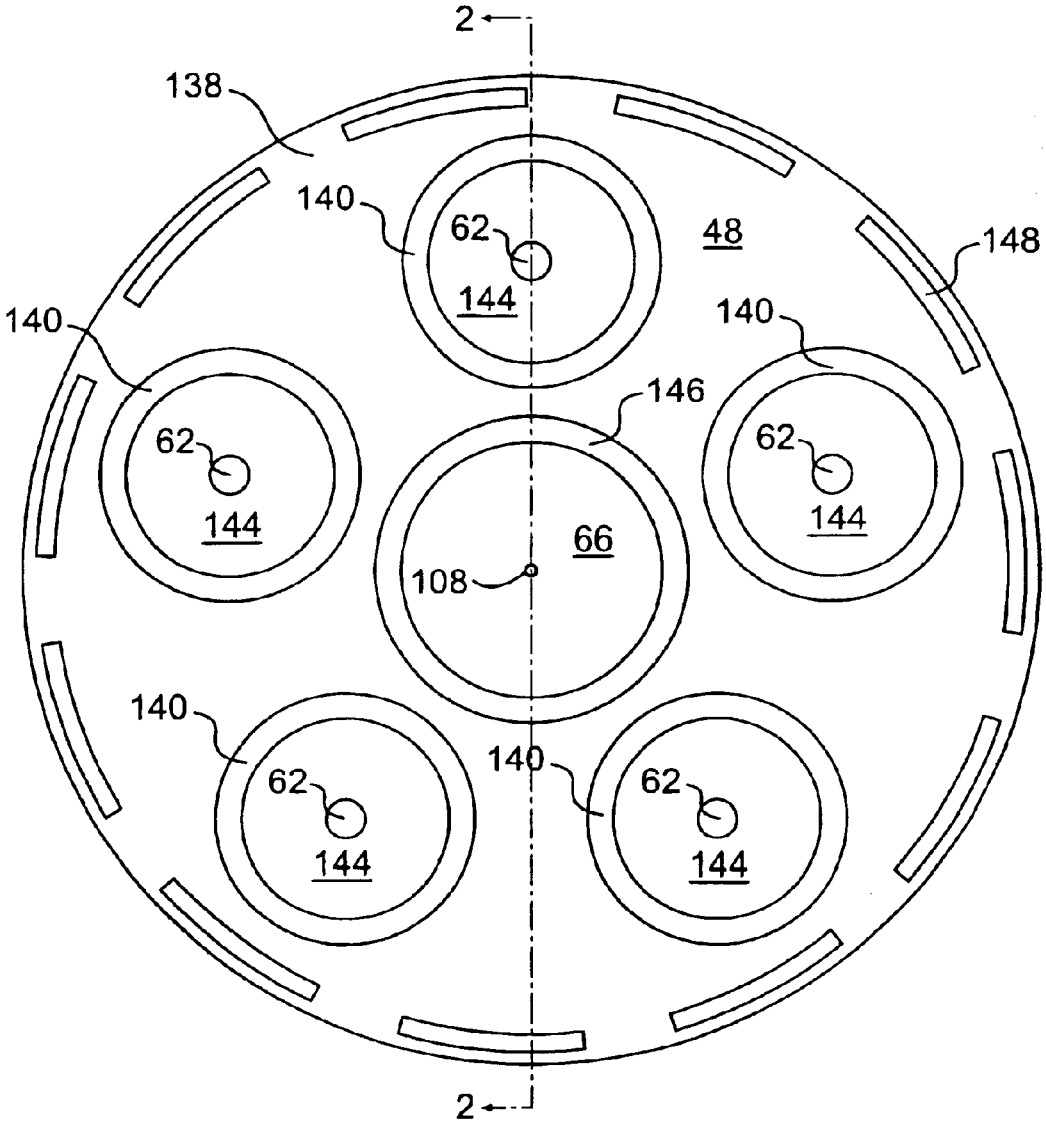
FIG. 3 is a plan view of a distal end of the axial piston pump taken at section 3—3 of FIG. 2.

FIG. 3 illustrates a distal end surface 139 of pump barrel 48 illustrated in FIG. 2. Distal end surface 139 may include a plurality of ring-shaped lands or protrusions 140 centered about and completely surrounding each fluid pool passage 62 of each pump chamber 56. The area formed within ring-shaped protrusion 140 and between the distal end surface 139 of pump barrel 48 and a distal end surface 142 (FIG. 2) of pump housing 44 forms an area for a pressurized fluid pool 144. A ring-shaped land or protrusion 146 may also be formed on distal end surface 139 and centered about central outlet 66 of pump barrel 48. The size and shape of protrusions 140 and 146 may be varied so long as they surround their respective passage or outlet.

Distal end surface 139 of pump barrel 48 may also include a plurality of outer lands or protrusions 148 spaced about an outer radial portion of the pump barrel 48. Outer lands 148 may be configured to match the curved contour of pump barrel 48, or could be of any other suitable shape, and may be equally spaced about distal end surface 139. Each land or protrusion 140, 146 and 148 formed on end surface 139 of pump barrel 48 may include a planar top surface forming a bearing surface against distal end surface 142 of pump housing 44 during the relative rotation of the pump barrel 48 and the pump housing 44.

Figure 4:
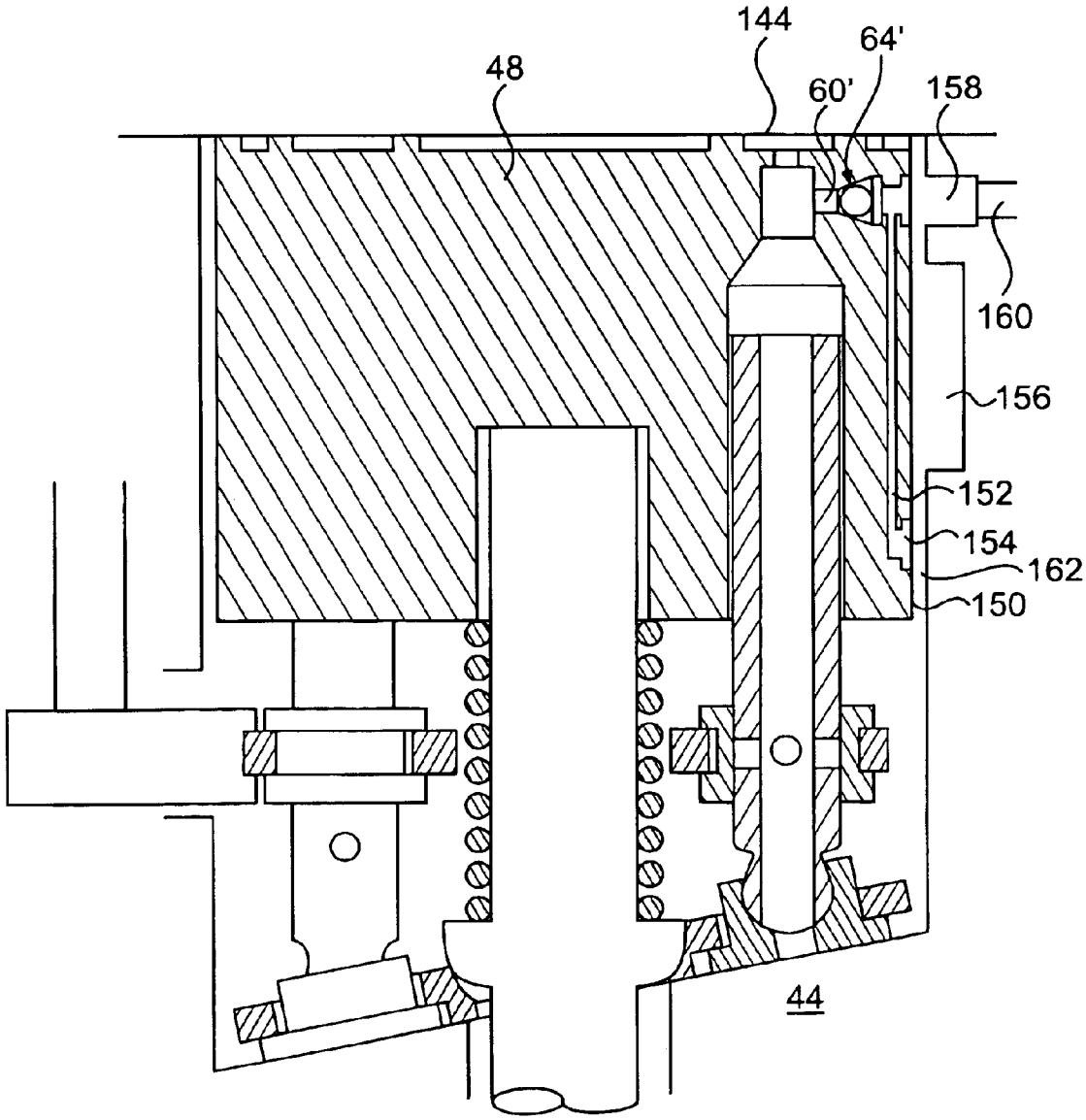
FIG. 4 is a cross-section diagrammatic view of an alternative arrangement of an axial piston pump according to an exemplary embodiment of the present invention.

FIG. 4 illustrates another embodiment of the present invention. This embodiment includes all of the aspects of the embodiment shown in FIGS. 2 and 3 described above, except central outlet 66 is removed and high pressure outlet passages 60' extends radially outwardly through a check valve 64', rather than radially inwardly within pump barrel 48. Accordingly, outlet passage 60' opens into a side surface 150 of pump barrel 48. Also in this embodiment, an axial passage 152 is formed in pump barrel 48 to connect with radial passage 60' and may extend proximally within pump barrel 48. A radial passage 154 may then be included to connect the proximal end of axial passage 152 with side surface 150 of pump barrel 48. Axial passage 152 may be formed so as not to extend through to the distal end 54 or proximal end 52 of pump barrel 48.

Pump housing 44 of the embodiment of the invention illustrated in FIG. 4 may include a recess 156 formed therein extending about the entire circumference of housing chamber 106. Further, pump housing 44 may include a common outlet 158 connecting outlet passages 60' of each pump piston 58 to a single outlet 160 connected to high pressure supply conduit 22. In an alternative configuration, either or both of passages 152 and 154, and recess 156 may be formed in pump housing 44 rather than in pump barrel 48.

INDUSTRIAL APPLICABILITY

In operation, rotation of the drive shaft of engine causes rotation of shaft 46 of pump 18. This rotation of shaft 46 acts to rotate pump barrel 48 and pump pistons 58 relative to pump housing 44. Compression spring 102 urges shaft 46 against biasing plate 90 to maintain piston shoe 80 and pump piston 58 against angled bearing surface 120 of pump housing 44. Accordingly, rotation of pump barrel 48 and pump pistons 58 cause pump pistons 58 to reciprocate in accordance with the axial rise and fall of angled bearing surface 120. During a suction stroke of a pump piston 58 (associated with movement of the piston from its top-dead-center, distal-most, position to its bottom-dead-center, proximal-most position), low pressure fluid is drawn from low pressure supply line 16 into housing chamber 106, in through the inlet passage 122, through piston shoe bore 80 and into axial bore 72 and pump chamber 56. During a discharge stroke of a pump piston 58 (associated with movement of the piston from its bottom-dead-center, proximal-most, position to its top-dead-center, distal-most, position), pump piston 58 has rotated out of alignment with inlet passage 122 so that movement of pump piston 58 in a distal direction reduces the size of pump chamber 56 to pressurize the fluid within axial bore 72 and pump chamber 56. Some of the pressurized fluid is then expelled through outlet passage 60, beyond check valve 64, into central outlet 66, into outlet passage 116 of pump housing 44, and through high pressure supply line 20 to common rail 22.

As discussed above, if a desired fluid pressure in rail 22 is different than the actual pressure in rail 22, the amount of high pressure fluid leaving pump 18 may be varied by control assembly 40. Control assembly 40 may include control actuator 128, control lever 126, rotating idler ring 134 and piston control sleeves 138. If electric control module 32 determines that pump 18 is supplying excess fluid through high pressure supply line 20 to rail 22, a signal may be sent along communication line 42 to control assembly 40 to move actuator 128, control lever 126, idler ring 134 and control sleeves 138 so that radial ports 74 of pump piston 58 are uncovered at some point during the piston's discharge stroke. Once radial ports 74 are uncovered, pressurized fluid within pump chamber 56 and axial bore 72 is expelled to housing chamber 106, rather than through outlet passage 60. Thus, the position of control sleeve 138 on pump piston 58 controls the amount of fluid in pump chamber 56 that is pressurized and forced through high pressure outlet passage 60.

During the discharge stroke of pistons 58, high pressure fluid is also supplied through fluid pool passage 62 to form the pressurized fluid pool 144 within the hollow portion of ring-shaped protrusion 140, and between distal end surface 142 of pump housing 44 and distal end surface 139 of pump barrel 48. The formation of the contained pressurized fluid pool 144 acts to urge distal end surface 139 of the pump barrel 48 away from distal end surface 142 of pump housing 44, and thus reduce contact forces between the pump barrel 48 and pump housing 44. The greatest contact forces between the pump barrel 48 and pump housing 44 correspond to an area of distal end 54 of pump barrel 48 adjacent the piston performing its discharge stroke. This results from the high pressures formed within the pump chamber 56 acting to force pump barrel 48 against pump housing 44. Accordingly, the pressurized fluid pool 144 is always formed during the time of maximum contact forces between the pump barrel 48 and pump housing 44.

Protrusion 146 acts to seal off the central outlet 66 carrying high pressure fluid from housing chamber 106 containing low pressure fluid. Further, outer protrusions 148 assist in radially aligning pump barrel 48 in housing chamber 106, yet permit fluid existing between end surfaces 139 and 142 to communicate with the low pressure fluid of housing chamber 106.

The embodiment of the invention illustrated in FIG. 4 acts in a manner similar to that described above in connection with the embodiment of FIGS. 2 and 3, including the formation of a pressurized fluid pool 144. The embodiment of FIG. 4 also includes the use of high pressure fluid to reduce contact of pump barrel 48 with pump housing 44 resulting from radial forces created during pump operation. During pump operation, high pressure fluid travels from outlet passage 60' through check valve 64' and through outlets 158 and 160 to high pressure supply line 20. Some of the high pressure fluid also travels through axial passage 152 to radial passage 154 and into an axial gap 162 formed between the side surface 150 of pump barrel 48 and housing side 110 of pump chamber 106. The high pressure fluid can then flow into housing recess 156. Accordingly, a pressure pool is created within recess 156 to assist in radially aligning pump barrel 48 within pump housing 44, and reduce wear between these parts of the pump 18. High pressure fluid traveling into outlet passage 158 from passage 60' may also travel through axial gap 162 and into housing recess 156 to assist in the formation of a balance pool in recess 156.

The pressurized fluid pool 144, alone or in combination with pressurized fluid pool formed in recess 156, creates a fluid bearing that reduces wear between moving and stationary parts of pump 18. Accordingly, the fluid bearings may reduce the need or load on mechanical bearings, which in turn can extend the life of the pump or reduce the duration between maintenance of the pump.

Other embodiments of the invention will be apparent to those skilled in the art from consideration of the specification and practice of the invention disclosed herein. For example, pressure balance pools of the present invention may be used with pumps that have non-rotating pistons and a rotating angled bearing surface (i.e. swash plate). In such a pump, the balance pools could be used to reduce wear between the piston shoes and rotating angled bearing surface. Further in accordance with the present invention, pump 18 could include less than all of the balance pools disclosed above, for example, only one balance pool centered about central longitudinal axis 67 of pump housing 48. Further, the balance pool 156 formed along the side 150 of rotating pump barrel 48 may be the only balance pool included with the pump. Even further, protrusions similar to protrusion 140 formed on the distal end surface 139 of pump barrel 48 may be formed on side 150 of pump barrel. Protrusions 140, 146 and 148 may alternatively be formed on the appropriate surface of pump housing 44, rather than on surfaces of pump barrel 48. It is intended that the specification and examples be considered as exemplary only, with a true scope and spirit of the invention being indicated by the following claims.

What is claimed is:

1. A pump comprising:

a stationary pump housing having a central longitudinal axis and a housing chamber;

a rotating pump shaft extending through the pump housing and into the housing chamber;

a rotating barrel fixed to the pump shaft and including a plurality of pump chambers;

a plurality of rotating and reciprocating pump pistons, each pump piston at least partially contained within a respective pump chamber;

a fluid delivery control assembly configured to selectively vary the amount of fluid delivered by the pump;

at least one pressurized fluid pool located between a portion of the rotating barrel and a portion of the pump housing; and a pump outlet path separate from the at least one pressurized fluid pool.

2. The pump according to claim 1, wherein a passage connects a pump chamber with the at least one pressurized fluid pool.

3. The pump according to claim 2, further including a protrusion formed on a surface of one of the rotating barrel and pump housing in an area surrounding the passage, the pressurized fluid pool being at least partially contained within a hollow portion of the protrusion and between associated surfaces of the rotating barrel and pump housing.

4. The pump according to claim 3, wherein the protrusion has a ring-shaped configuration.

5. The pump according to claim 1, wherein the at least one pressurized fluid pool includes a plurality of pressurized fluid pools equal in number to the plurality of pump chambers, and a separate passage connects each pressurized fluid pool to a respective pump chamber.

6. The pump according to claim 1, wherein the pressurized pool is located at an end of the rotating barrel.

7. The pump according to claim 6, wherein an additional pressurized pool is located along a side of the rotating barrel.

8. The pump according to claim 7, wherein the additional pressurized pool located along the side of the rotating barrel includes a recess extending completely around a portion of the rotating barrel.

9. The pump according to claim 1, wherein the plurality of pump pistons each extend generally parallel to the central longitudinal axis of the pump housing.

10. The pump according to claim 9, wherein the fluid delivery control assembly includes a plurality of slidable sleeves, each slidable sleeve located on a respective piston and controllably positionable to uncover a port in the pump piston that is fluidly connected to the pump chamber.

11. A method of reducing wear in a pump comprising:

pressurizing fluid during a discharge stroke of at least one piston of the pump; and forming a plurality of contained pools of a portion of the pressurized fluid between portions of opposed surfaces of a rotating barrel and a housing of the pump, the rotating barrel including at least one pump chamber housing at least a portion of the at least one piston.

12. The method of reducing wear in a pump according to claim 11, wherein the at least one piston includes a plurality of pistons and the at least one pump chamber includes a plurality of pump chambers; and each of the plurality of contained pools being fluidly connected to a respective pump chamber.

13. The method of reducing wear in a pump according to claim 11, wherein each of the plurality of contained pools is located within a hollow portion of a protrusion, the protrusion being located on a surface of one of the rotating barrel and pump housing.

14. The method of reducing wear in a pump according to claim 11, wherein each of the plurality of contained pools is located at an end of the rotating barrel.

15. The method of reducing wear in a pump according to claim 14, wherein an additional contained pool is located along a side of the rotating barrel.

16. The method of reducing wear in a pump according to claim 15, wherein the additional contained pool located along the side of the rotating barrel includes a recess extending completely around a portion of the rotating barrel.

17. The method of reducing wear in a pump according to claim 11, wherein the at least one piston includes a plurality of pistons and the at least one pump chamber includes a plurality of pump chambers, and each piston extends generally parallel to a central longitudinal axis of the pump.

18. The method of reducing wear in a pump according to claim 17, wherein the pump includes a delivery control assembly having a plurality of slidable sleeves, each slidable sleeve located on a respective piston and controllably positionable to uncover a port in the pump piston that is fluidly connected to the pump chamber.

19. A hydraulically actuated system, comprising:

a pump having a central longitudinal axis, a stationary pump housing, a rotating pump shaft, a rotating barrel fixed to the pump shaft, a plurality of rotating and reciprocating pump pistons at least partially located in pump chambers of the rotating barrel, a fluid delivery control assembly, at least one pressurized fluid pool located between a portion of the rotating barrel and a portion of the pump housing, and a pump outlet path separate from the at least one pressurized fluid pool;

a high pressure rail connected to the pump;

at least one hydraulically actuated fuel injector connected to the high pressure rail; and an electronic control module in communication with and capable of controlling the fluid delivery control assembly.

20. The hydraulically actuated system according to claim 19, wherein a passage connects a pump chamber with the at least one pressurized fluid pool.

21. The hydraulically actuated system according to claim 20, further including a protrusion located on a surface of one of the rotating barrel and pump housing in an area surrounding the passage, the pressurized fluid pool being at least partially contained within a hollow portion of the protrusion and between associated surfaces of the rotating barrel and pump housing.

22. The hydraulically actuated system according to claim 21, wherein the protrusion has a ring-shaped configuration.

23. The hydraulically actuated system according to claim 19, wherein the at least one pressurized fluid pool includes a plurality of pressurized fluid pools equal in number to the plurality of pump chambers, and a separate passage connects each pressurized fluid pool to a respective pump chamber.

24. The hydraulically actuated system according to claim 19, wherein the pressurized pool is located at an end of the rotating barrel.

25. The hydraulically actuated system according to claim 24, wherein an additional pressurized pool is located along a side of the rotating barrel.

26. The hydraulically actuated system according to claim 25, wherein the additional pressurized pool located along the side of the rotating barrel includes a recess extending completely around a portion of the rotating barrel.

27. The hydraulically actuated system according to claim 19, wherein the plurality of pump pistons each extend generally parallel to the central longitudinal axis of the pump.

28. The hydraulically actuated system according to claim 27, wherein the pump delivery control assembly includes a plurality of slidable sleeves, each slidable sleeve located on a respective piston and controllably positionable to uncover a port in the pump piston that is fluidly connected to the pump chamber.

29. A pump comprising:

a stationary pump housing having a central longitudinal axis and a housing chamber;

a rotating pump shaft extending through the pump housing and into the housing chamber;

a rotating barrel fixed to the pump shaft and including a plurality of pump chambers;

a plurality of rotating and reciprocating pump pistons disposed in parallel about the central longitudinal axis of the pump housing, each pump piston at least partially contained within a respective pump chamber;

a fluid delivery control assembly configured to selectively vary the amount of fluid delivered by the pump, the assembly having a plurality of slidable sleeves, each slidable sleeve located on a respective piston and controllably positionable to uncover a port in the pump piston that is fluidly connected to the pump chamber; and a plurality of pressurized fluid pools located within a hollow portion of a protrusion located on one of the rotating barrel and pump housing and between a portion of an end surface of the rotating barrel and a portion of the pump housing.

30. The pump according to claim 29, wherein an additional pressurized pool is located along a side of the rotating barrel and includes a recess extending completely around a portion of the rotating barrel.

31. A method of reducing wear in a pump comprising;

pressurizing fluid during a discharge stroke of at least one piston of the pump; and forming a contained pool of a portion of the pressurized fluid between portions of opposed surfaces of a rotating barrel and a housing of the pump, the contained pool extending substantially parallel to a longitudinal axis of the pump and the rotating barrel including at least one pump chamber housing at least a portion of the at least one piston.

32. The method of reducing wear in a pump according to claim 31, wherein the at least one piston includes a plurality of pistons and the at least one pump chamber includes a plurality of pump chambers; and the method further includes forming a plurality of additional contained pools of pressurized fluid, each of the plurality of additional contained pools being fluidly connected to a respective pump chamber.

33. The method of reducing wear in a pump according to claim 32, wherein each of the plurality of additional contained pools is located within a hollow portion of a protrusion, the protrusion being located on a surface of one of the rotating barrel and pump housing.

34. The method of reducing wear in a pump according to claim 32, wherein each of the plurality of additional contained pools is located at an end of the rotating barrel.

35. The method of reducing wear in a pump according to claim 31, wherein the contained pool extending substantially parallel to a longitudinal axis of the pump includes a recess extending completely around a portion of the rotating barrel.

* * * * *